US007178290B2

(12) United States Patent
Gowland

(10) Patent No.: US 7,178,290 B2
(45) Date of Patent: Feb. 20, 2007

(54) MANHOLE COVER HAVING A LOCKING CROSSBAR

(76) Inventor: Stephen James Gowland, 2 Wilna Place, Helena Valley, Western Australia 6059 (AU)

( * ) Notice: Subject to any disclaimer, the term of this patent is extended or adjusted under 35 U.S.C. 154(b) by 337 days.

(21) Appl. No.: 10/802,438

(22) Filed: Mar. 17, 2004

(65) Prior Publication Data

US 2004/0182004 A1 Sep. 23, 2004

(30) Foreign Application Priority Data

Mar. 17, 2003 (AU) ..... 2003201290

(51) Int. Cl.
*E06B 11/00* (2006.01)

(52) U.S. Cl. ..... 49/33; 49/169; 49/463; 52/19

(58) Field of Classification Search ..... 49/33, 49/70, 169, 449, 463; 137/234.6; 52/19, 52/20, 21, 169.7, 169.6; 404/25, 26; 220/315; 292/259 R, 148, DIG. 11
See application file for complete search history.

(56) References Cited

U.S. PATENT DOCUMENTS 1,001,041 A * 8/1911 Jones ..... 49/33
2,025,839 A * 12/1935 Woods, Jr. ..... 49/21
2,163,221 A * 6/1939 Slocum ..... 404/25
2,883,853 A * 4/1959 Forni ..... 52/21
3,230,844 A * 1/1966 Isaacs ..... 49/35
3,501,874 A * 3/1970 Hahne ..... 52/20
4,621,939 A 11/1986 Thomann et al.
4,902,165 A * 2/1990 Embree ..... 404/25
5,951,200 A 9/1999 Barton
6,616,370 B1 * 9/2003 Signorelli ..... 404/25
6,616,371 B2 * 9/2003 Pate ..... 404/25
6,739,796 B1 * 5/2004 Del Nero et al. ..... 404/25

* cited by examiner

*Primary Examiner*—Gregory J. Strimbu
(74) *Attorney, Agent, or Firm*—Workman Nydegger

(57) ABSTRACT

A pit cover includes a casing, a cross bar and cover plate. The casing has a peripheral wall in the general shape of a rectangle, with open opposite ends and. The cross bar is coupled to and extends across the wall on an inside of the casing. The cover plate is configured to cover the first end of the casing. The cover plate has a first surface which, when the cover plate covers the first end of the casing is located on an outside of the casing. An enclosure is supported on a second opposite side of the cover plate and is provided with a slot through which a part 34 of the cross bar 14 can extend into the enclosure 28. A door 36 is coupled to the cover plate to provide access to the enclosure.

10 Claims, 4 Drawing Sheets

MANHOLE COVER HAVING A LOCKING CROSSBAR

CROSS-REFERENCE TO RELATED APPLICATIONS

Not applicable.

BACKGROUND OF THE INVENTION

1. The Field of the Invention

The present invention relates to a pit cover particularly, though not exclusively, for covering pits which provide access to underground utilities such as communication lines.

2. The Relevant Technology

Pits are provided in the ground to allow access to subterranean utilities such as communication lines, electricity cables, water and gas pipes enabling regular inspection, maintenance and repair. Covers are provided for the pits to ensure continuity of the ground so that people, animals and vehicles do not fall into the pits, and also to control access to the utilities. A typical pit cover includes a casing in the form of a rectangular box with an open top and bottom which is cemented into the ground to define an access opening to the pit, and a cover plate which is releasably locked to the casing. A bar extends across the casing which is used for fastening the plate to the casing. To this end, a cover plate is also provided with an enclosure through which the bar extends. The enclosure can be accessed by removing a disc-shaped door which is typically held by screws on the cover plate. A padlock is used to engage the bar and is disposed within the enclosure thereby preventing the plate from being removed from the casing.

One of the drawbacks of this type of pit cover is that the door can easily be removed by vandals simply unscrewing two screws leaving the lock exposed and vulnerable to cutting by bolt cutters. Whether the door is removed by vandals or the screws simply work loose by action of traffic, once the door is removed the open enclosure presents a tripping hazard. Additionally, the cross bar can often be manually pulled away from the casing thereby detaching the cross bar with the cover plate to allow unauthorized access to the pit and associate utilities.

SUMMARY OF THE INVENTION

According to the present invention there is provided a pit cover comprising:

a casing having a peripheral wall and an open first end;

a cross bar coupled to and extending across said peripheral wall on an inside of said casing;

a cover plate configured to cover said first end of said casing, said cover plate having: a first surface which when said cover plate covers said first end is located on an outside of said casing, and a second opposite surface; and, an enclosure supported on said second surface and having an opening through which a part of said cross bar can extend into said enclosure; and, a door coupled to said cover plate said door moveable between a first portion where said door closes said enclosure and a second position in which said door opens said enclosure to allow access to said enclosure from said first surface.

Preferably said pit cover further comprises biasing means associated with said door for biasing said door towards said first position.

Preferably said door is pivotally coupled to said cover plate.

Preferably said casing is provided with first and second catches for releasably catching said cross bar to couple said cross bar to said casing.

Preferably each of said catches comprises a slot open at one end and closed at an opposite end in which said cross bar is received.

Preferably said catches are formed separately from and fixed to said casing.

Preferably said cross bar comprises a first length extending in a first direction and one or more catch portions at each end of said first length, at least one catch portion at each end extending in a direction non-parallel to said first direction, said catch portions being receivable in respective catches.

Preferably said part of said cross bar is provided with a hole by which a locking device can lock onto said part to prevent said cover plate from being removed from said casing.

BRIEF DESCRIPTION OF THE DRAWINGS

An embodiment of the present invention will now be described by way of example with reference to the accompanying figures in which.

DETAILED DESCRIPTION OF THE PREFERRED EMBODIMENTS

Figure 2:
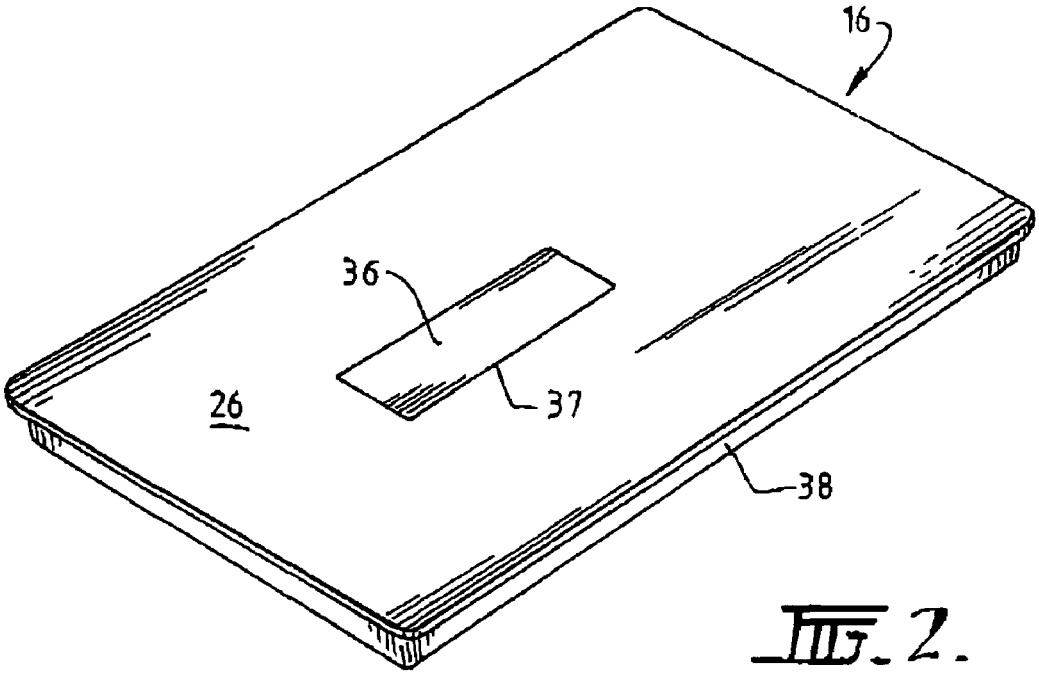
FIG. 2 is a perspective view of a cover plate incorporated in the pit cover having an associated door in a closed position.
Figure 3:
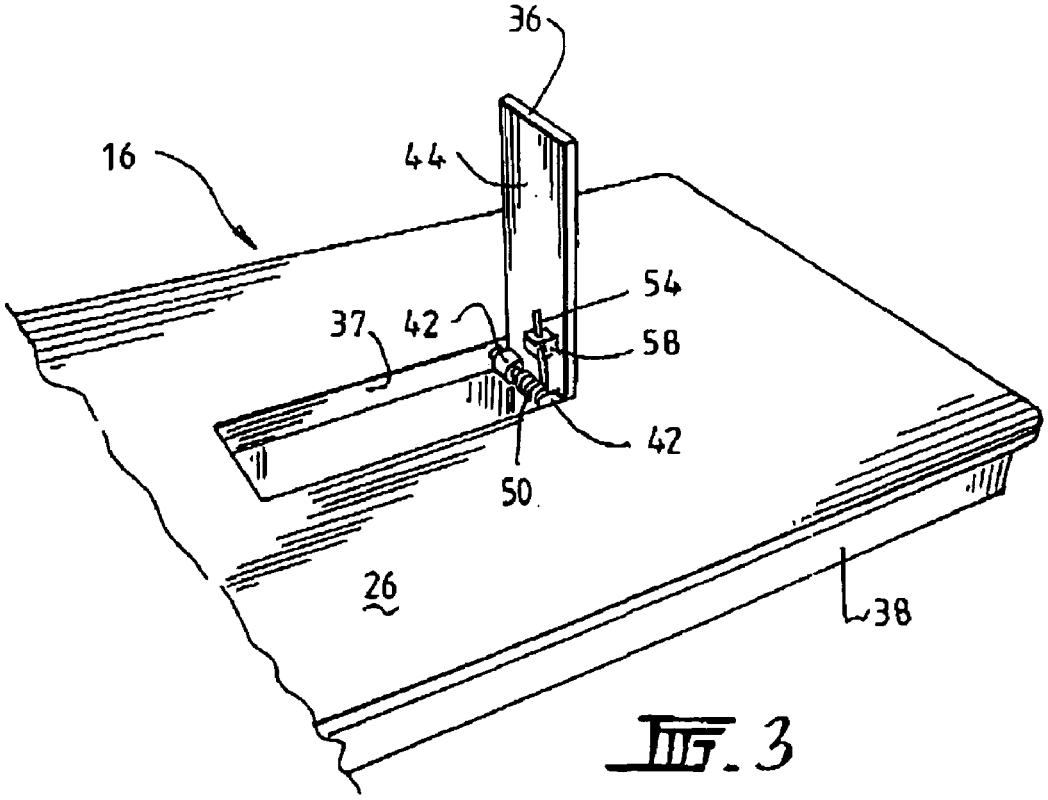
FIG. 3 is a partial view of the cover plate depicted in FIG. 2 with the door in an opened position.

Referring to the accompanying drawings, an embodiment of a pit cover 10 in accordance with the present invention comprises a casing 12, a cross bar 14 and a cover plate 16. The casing 12 has, a peripheral wall 18 which is in the general shape of a rectangle and, open opposite ends 20 and 22. The open end 20 may be considered as a top of the casing and the end 22 the bottom. As shown most clearly in FIG. 1, the cross bar 14 is coupled to and extends across the wall 18 on an inside 24 of the casing 12. The cover plate 16 is configured to cover the first end or top 20 of the casing. The cover plate 16 has a first or upper surface 26 which, when the cover plate 16 covers the first end 20 of the casing 12 is located on an outside of the casing 12. An enclosure 28 is supported on a second opposite (or bottom) surface 30 of the cover plate 16 and is provided with an opening in the form of a slot 32 through which a part, in the form of a tab 34, of the cross bar 14 extends into the enclosure 28. A door 36 is coupled to the cover plate 16 to provide access to the enclosure 28. The door 36 is moveable between a first position, depicted in FIGS. 1 and 2, where it closes the enclosure 28, and a second position, depicted in FIGS. 3 and 4, where the door allows access to the enclosure 28.

In use, the casing 12 would typically be cemented about the opening of a pit to an underground utility. The cover plate 16 is placed over the top 20 of the casing 12 so that the tab 34 projects through the opening 32. The door 36 can be opened to allow a locking device such as a padlock to be engaged with the tab 34 thereby effectively coupling the cross bar 14 with the cover plate 16. As the cross bar is also coupled with the casing 12, this effectively locks the cover plate 16 to the casing 12.

A flat bar bracing 38 depends from surface 30 and extends inboard of, and about, the cover plate 16. The bracing 38 sits inside end 20 with the portion of the cover plate 16 outside of the bracing 38 extending across and sitting on the upper surface of end 20. The door 36 is of a generally rectangular shape and located generally centrally in the cover plate 16, with the major length of the door 36 extending in the same direction as the major length of the cover plate 16. Most conveniently the door 36 is formed by cutting it out of the cover plate 16 leaving a hole or opening 37 of complementary configuration within which the door 36 resides when in the first (closed) position. When the door 36 is in its first or closed position, it lies flush with the cover plate 16.

Figure 1:
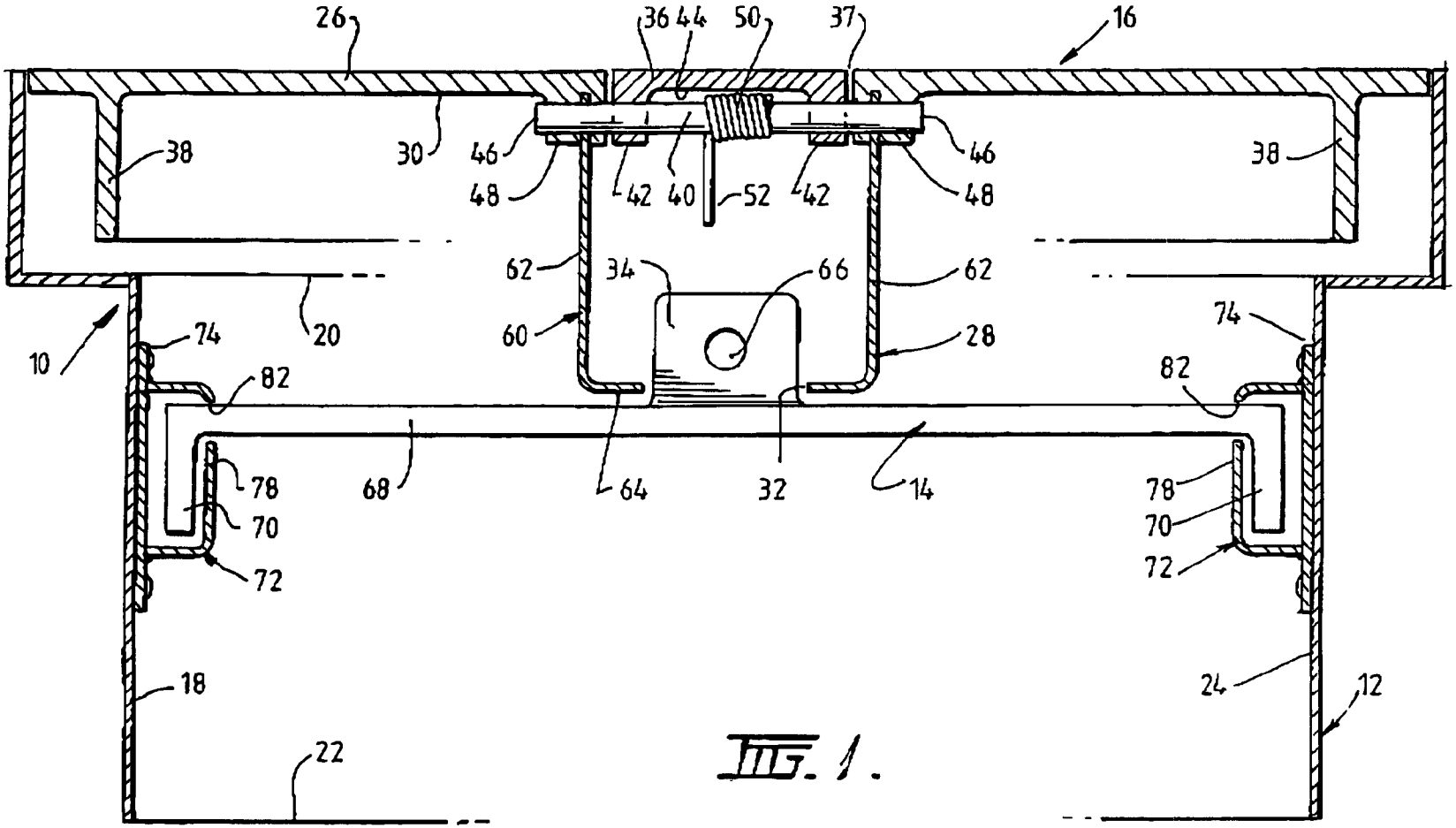
FIG. 1 is a cross-sectional view of an embodiment of a pit cover in accordance with the present invention.
Figure 4:
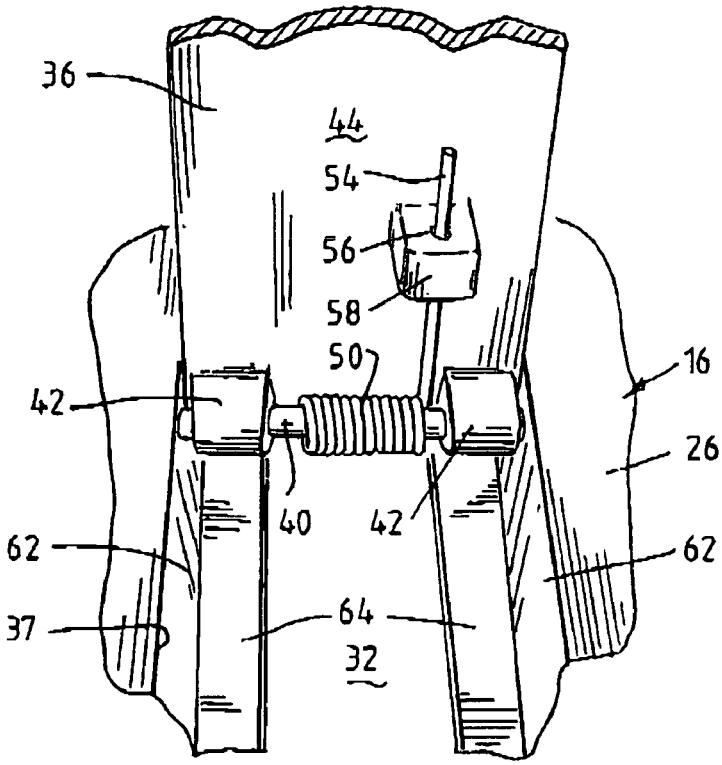
FIG. 4 is an enlarged front view of a portion of the cover plate with the door in an opened position.

With reference to FIGS. 1 and 4, the door 36 is pivotally coupled to the cover plate 16 via a pivot pin 40. The pin 40 passes through two spaced apart tubular lugs 42 which are fixed to an underside 44 at one end of the door 36. Opposite free ends 46 of the pin 40 extend into respective tubular lugs 48 fixed to the surface 30 of the cover plate 16. A bias means in the form of a spring 50 is coiled about the pin 40 between the lugs 42 to bias the door 36 to the first or closed position depicted in FIGS. 1 and 2. The spring 50 has a length 52 at one end which abuts, or can abut, a surface of the enclosure 28 or the surface 30 of the plate 26. A second length 54 of the spring 50 at an opposite end passes through a hole 56 formed in a block 58 fixed to the underside 44 of the door 36.

The enclosure 28 is in the form of an open top box 60 having side walls 62 which depend from the surface 30 of the plate 16 about the periphery of the hole 37 in the plate 16 which accommodates the door 36. The box 60 includes a bottom wall 64 which lies parallel to the cover plate 16 and in which is formed the opening or slot 32 to receive the tab 34. It should be recognized that when the door 36 is open with the tab 34 projecting into the enclosure 28, no access is available to the inside 24 of the casing 12 or indeed to the pit in which the pit cover 10 is fitted. By passing the bolt of a padlock through a hole 66 formed in the tab 34, the cover plate 16 is effectively locked to the cross bar 14 which in turn is coupled to the casing 12 thereby preventing removal of the cover plate 16.

Figure 5:
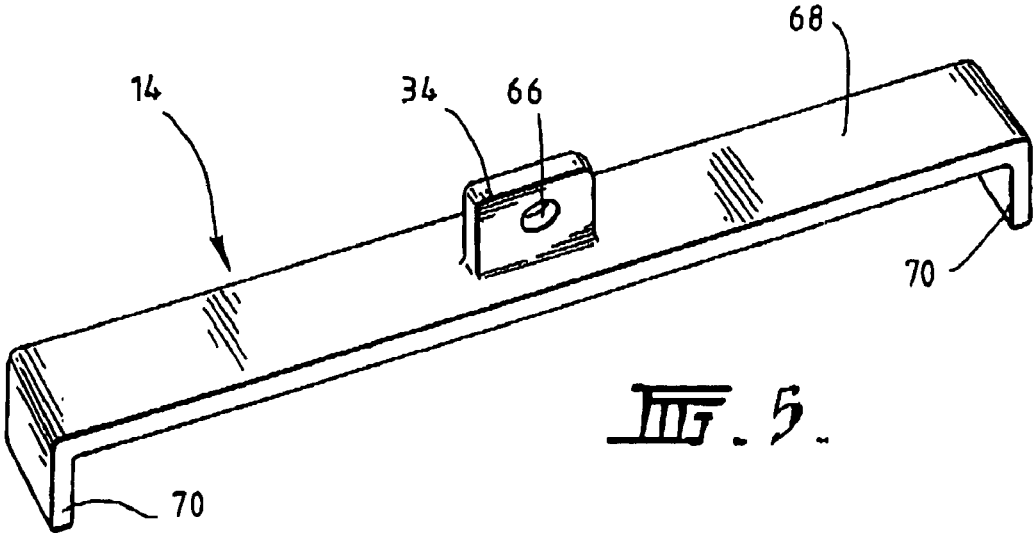
FIG. 5 is a perspective view of a cross bar incorporated in the pit cover.

With particular reference to FIGS. 1 and 5, the cross bar 14 includes a first length 68 in the form of a strip or flat bar which extends in a first direction and one or more (in this particular instance only one) catch portion 70 at each end of the length 68. The catch portions 70 are in the form of catch legs that extend in a direction non-parallel with and moreover in this embodiment at right angles to, the direction of the first length 68. The catch portions 70 may be formed integrally with the first length 68 by appropriate bending of a flat or strip bar. Alternately, the catch portions 70 may be welded or otherwise fixed to the ends of the first length 68. The tab 34 may be made from the same material as the first length 68 and/or catch portion 70 and extends upwardly from the first length 68.

Figure 7:
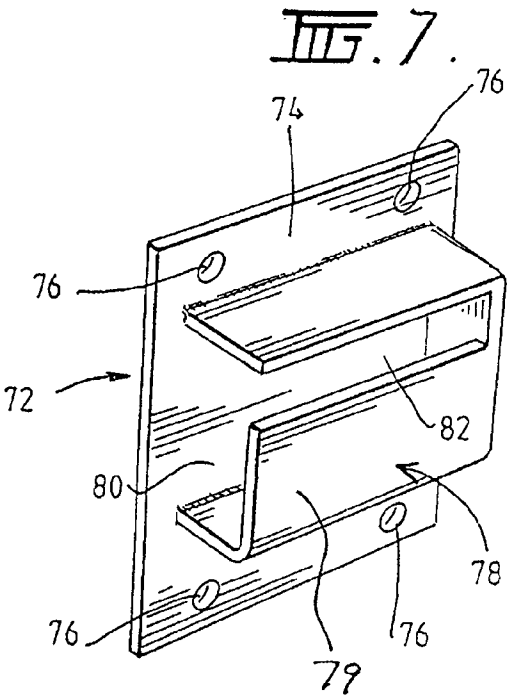
FIG. 7 is a perspective view of a catch incorporated in the pit cover.
Figure 6:
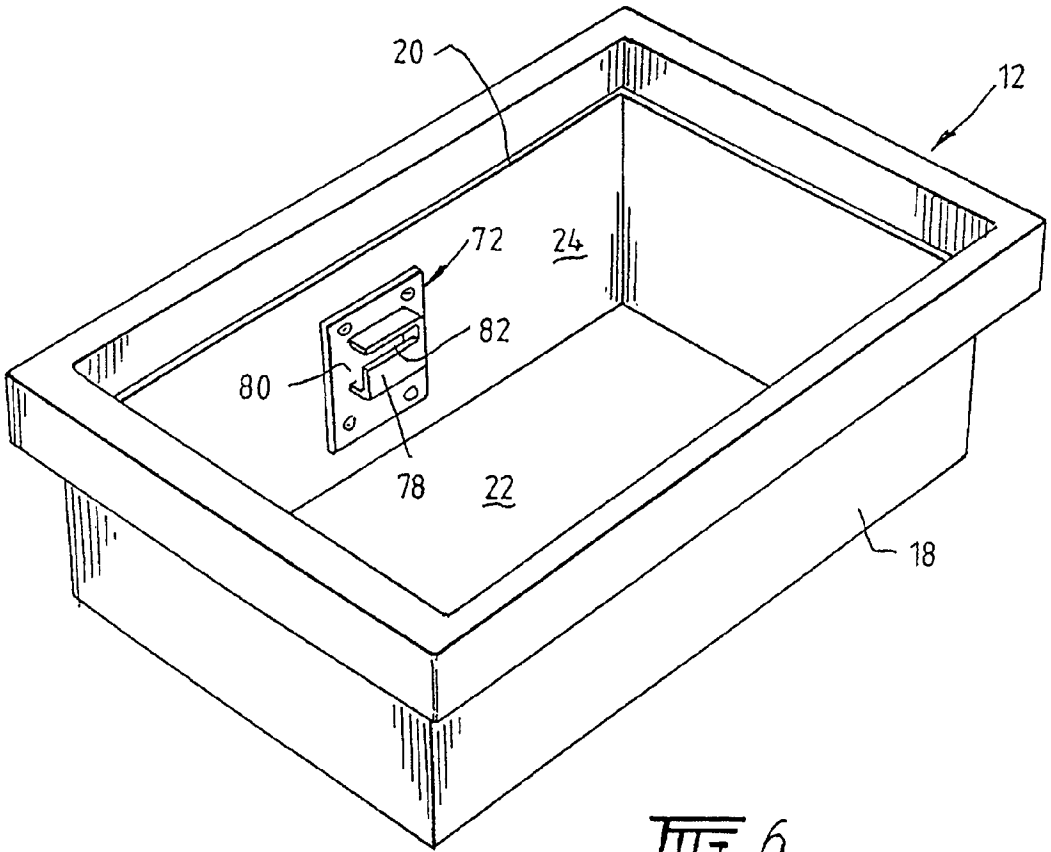
FIG. 6 is a perspective view of a case portion of the pit cover.

Opposite ends of the cross bar 14 are coupled to the casing 12 via respective catches 72 (see FIGS. 1, 6 and 7). Each catch 72 includes a back plate 74 provided with four spaced apart holes 76 to allow fastening of the catches 72 to the walls 18 on the inside 24 of the casing 12. A box-like structure 78 is fixed to the back plate 74 and is provided with an open end 80, a catch wall 79 that extends parallel to the back plate 74, and a slot 82 extending longitudinally along the catch wall 79 from the open end 80. The cross bar 14 is coupled to the casing 12 by sliding the catch portions 70 into the box-like structures 78 from the open end 80. When the cover plate 16 is placed over the end 20 of the casing 12 with the tab 34 projecting into the enclosure 28, the cross bar 14 is prevented from sliding out of the box-like structure 78.

It would be appreciated that in the above described embodiment of the pit cover 10, the door 36 is always attached to the cover plate 16 via the pivot pin 40 and cannot be easily detached. In addition, biasing the door 36 ensures that in the absence of a third party deliberately moving the door 36 to the opened position, the door 36 will stay closed so that the cover plate 16 and door 36 provide a substantially planar continuous surface. Additionally provision of the catch portions 70 on the cross bar 14 reduce the likelihood of unauthorized users manually forcing the cover plate 16 from the casing 18 which is known to occur with prior pit covers where sufficient manual force can deflect the cross bar sufficiently to detach its ends from the casing. Further by appropriate shaping and dimensioning of the opening 37 in which door 36 resides the insertion of bolt cutters for the purposes of cutting a padlock engaged with tab 34 can be prevented. To this end the opening 37 is ideally rectangular in shape with dimensions in the order of 200 mm×70 mm.

Now that an embodiment of the pit cover 10 has been described in detail it will be apparent to those skilled in the relevant arts that numerous modifications and variations may be made without departing from the basic inventive concepts. For example, in the illustrated embodiment, the catch portions 70 are depicted as extending in a downward direction from the ends of the length 68 of cross bar 14. However, if desired they may be configured to extend upwardly in the same direction as the tab 34. In addition, the catch portion 70 may be formed of a different configuration for example they may extend on opposite sides of the first lengths 68 to also provide the cross bar 14 with a generally eye-shaped profile. In addition, the casing 12 and cover plate 16 may be relatively configured so that the bracing 38 is either disposed on the outside or the inside of the casing 12. Further, different forms of hinging or coupling may be provided other than the pivot pin 40 to pivotally couple the door 36 to the cover plate 16.

All such modifications and variations are deemed to be within the scope of the present invention the nature of which is to be determined from the above description and the appended claims.

In the claims which follow and in the preceding description of the invention, except where the context requires otherwise due to express language or necessary implication, the word "comprise" or variations such as "comprises" or "comprising" is used the an inclusive sense, i.e. to specify the presence of the stated features but not to preclude the presence or addition of further features in various embodiments of the invention.

What is claimed is:

1. A pit cover comprising:

a casing having a peripheral wall and an open end;

a cover plate configured to cover the open end of the casing;

a crossbar comprising a bar extending in a first direction, the bar having first and second opposite ends with respective catch legs extending from the first and second ends in a second direction not parallel to the first direction, the crossbar further comprising a projecting tab which is releasably lockable to the cover plate; and first and second catches provided at sides of and locations on an inside surface of the peripheral wall, each of the catches comprising a catch wall spaced from the peripheral wall and each catch wall provided with a slot for receiving a respective one of said ends of the bar with a respective one of said catch legs located between the peripheral wall and a respective the catch walls.

2. A pit cover according to claim 1, wherein the cover plate has a first surface and an opposite second surface, the first surface being located on an outside of the casing when the cover plate covers the open end of the casing; and wherein the pit cover further comprises an enclosure supported on the second surface of the cover plate, the enclosure having an opening through which the tab is extendable into the enclosure.

3. A pit cover according to claim 2 wherein said cover plate comprises a bracing depending from said second opposite surface and extending inboard of an outer perimeter of said cover plate, and about said cover plate.

4. A pit cover according to claim 2, further comprising a door coupled to the cover plate, the door being movable between a first position where the door prevents access to the enclosure and an upper surface of the door is substantially co-planar with the first surface; and a second position in which the door allows access to the enclosure from the first surface.

5. A pit cover according to claim 4 further comprising biasing means associated with said door for biasing said door towards said first position.

6. A pit cover according to claim 5 wherein said door is pivotally coupled to said cover plate.

7. A pit cover according to claim 1 wherein said catches are formed separately from and fixed to said casing.

8. A pit cover according to claim 1, wherein each catch comprises a box shaped structure that is fastened to the inside surface of the peripheral wall, the catch walls forming a part of the box shaped structures and extending parallel to the inside surface of the peripheral wall.

9. A pit cover according to claim 1, wherein a hole is formed in the projecting tab, such that the hole is disposed inside an enclosure when the projecting tab extends into the enclosure, and wherein a locking device is engageable with the hole in the tab to prevent withdrawal of the tab from the enclosure.

10. A pit cover according to claim 1, wherein said second direction is substantially perpendicularly to the first direction.

* * * * *